United States Patent [19]

Hida

[11] 4,401,721

[45] Aug. 30, 1983

[54] THERMOSENSITIVE RECORDING MATERIALS

[75] Inventor: Yoshiaki Hida, Kawasaki, Japan

[73] Assignee: Dai Nippon Insatsu Kabushiki Kaisha, Tokyo, Japan

[21] Appl. No.: 322,756

[22] Filed: Nov. 19, 1981

[51] Int. Cl.[3] ..... B41M 5/18

[52] U.S. Cl. ..... 428/484; 282/27.5; 427/150; 427/151; 427/152; 428/531; 428/692; 428/913

[58] Field of Search ..... 427/150–152; 428/488, 537, 913, 914, 141, 195, 211, 320.4, 320.6, 320.8, 484, 511, 531, 692; 282/27.5

[56] References Cited

U.S. PATENT DOCUMENTS

| | | | |
|---|---|---|---|
| 3,847,645 | 11/1974 | De Laurentis et al. | 117/36.9 |
| 3,965,282 | 6/1976 | Jansseus et al. | 282/27.5 |
| 4,098,114 | 7/1978 | Asao et al. | 428/914 |
| 4,183,553 | 1/1980 | Petitpierre | 282/27.5 |

*Primary Examiner*—Bruce H. Hess
*Attorney, Agent, or Firm*—Parkhurst & Oliff

[57] ABSTRACT

A novel thermosensitive recording material suitable for credit cards, season tickets or passes, and the like to be used for a relatively long period comprises a substrate, a first thermosensitive layer having an acidic developer dispersed in a solid vehicle and laminated on the substrate, and a second thermosensitive layer having a leuco-dye dispersed in a solid vehicle and laminated on the first thermosensitive layer. The recording material can further have a primer layer, an overcoat layer and/or a magnetic recording layer.

14 Claims, 7 Drawing Figures

THERMOSENSITIVE RECORDING MATERIALS

BACKGROUND OF THE INVENTION

This invention relates to thermosensitive recording materials which have good thermal stabilities and are suitable for cards to be used for a relatively long period of time such as season tickets or passes and credit cards.

In recent years, thermosensitive recording systems have been widely employed as output recording systems such as those for transmission-information recording (e.g., facsimile), output recording in electronic computers, and output recording in various testers, as well as printer systems in automatic ticket machines. Moreover, the utilization of such systems for issuing season tickets, credit cards, various commutation tickets or passes and the like to be used for relatively long periods (hereinafter generally referred to as "long-term cards" is also coming under study. This is because thermosensitive recording systems have such features as their affording recordings in which the information contents can be directly viewed by eye and simpler maintenance, and more compact and less expensive apparatus in comparison with other printer systems such as ribbon printers.

As recording materials to be employed in such thermosensitive recording systems, recording materials in each of which a thermosensitive layer comprising a color former such as leuco-dyes and a developer such as phenolic compounds dispersed in a solid vehicle is formed on a substrate have been generally used. When the thermosensitive layer is heat-printed by a thermal head or a heating pen, the color former and/or the developer contained in the binder (solid vehicle) is melted or sublimated in the heat-printed portions, and both the color former and developer are closely contacted and reacted to produce color.

There are some problems, however, in the use of such a recording material for long-term cards as mentioned above because of inadequate thermal stabilities principally in the course of storage after or before issuing of the cards. More specifically, such long-term cards must maintain clear recordings in their thermosensitive layers during their period of use after issuance, and therefore they are required to have no fogging in the thermosensitive layer and no fading of printed recording. Because the long-term cards are expected to be exposed to a temperature as high as 80° C. especially in summer (for example, when they are left in automobiles), the above mentioned requirement must be satisfied also under such a high temperature condition.

Furthermore, a thermosensitive recording apparatus is relatively inexpensive and compact, and consequently may be installed at a place where temperature conditions are relatively unfavorable, for example, in front of shops or stations. Thus, unprinted recording materials corresponding to before-issue long-term cards are also desired to neither produce color at a high temperature of about 80° C. nor decrease in color-producing performance at the time of recording.

As described above, the thermosensitive recording materials to be used for long-term cards are required to have particularly excellent thermal resistance, but the conventional thermosensitive recording materials have not always satisfied this requirement.

To solve this problem, there have been proposed a method for decreasing the color-producing sensitivity and raising the color-producing temperature by lowering the concentration of a color former or a developer contained in the thermosensitive layer and a method of adding to a thermosensitive layer a water-insoluble alkaline inorganic pigment such as calcium carbonate or magnesium carbonate (Japanese Laid-open Patent Publication No. 6077/1980).

Such methods, however, are not effective in preventing fading of printed recordings or decrease in color-producing performance when unprinted recording materials are stored.

SUMMARY OF THE INVENTION

In view of the above described circumstances, it is an object of the present invention to provide thermosensitive recording materials which are suitable for uses in long-term cards and also have such thermal stabilities that fogging in unprinted or printed recording materials, fading of printed recordings, and deterioration of color-producing performance of unprinted recording materials present almost no problem even after storage thereof at high temperatures of about 80° C.

I have carried out research on thermosensitive color-producing systems comprising combinations of leuco-dyes and acidic developers. As a result I have found that, whereas thermosensitive layers in a state wherein these two components are present as a mixture have heretofore been formed, a thermosensitive recording material of markedly improved thermal stability can be obtained by disposing two thermosensitive layers on a substrate in a specific order, these two thermosensitive layers respectively containing one of these two components.

According to this invention, which is based on the above discovery, there is provided a laminated thermosensitive recording material comprising a substrate, a first thermosensitive layer which comprises a solid vehicle and an acidic developer dispersed therein and is disposed on the substrate, and a second thermosensitive layer which comprises a solid vehicle and a leuco-dye dispersed therein and is disposed on the first thermosensitive layer.

The nature, utility, and further features of this invention will be more clearly apparent from the following detailed description beginning with a consideration of general aspects of the invention and concluding with specific examples of practice thereof and comparison examples.

DETAILED DESCRIPTION OF THE INVENTION

The present invention is characterized by disposing on a substrate the first thermosensitive layer wherein an acidic developer is dispersed in a solid vehicle and then the second thermosensitive layer wherein a leuco-dye is dispersed in a solid vehicle in this coating order.

It is still not fully made clear why the thermosensitive recording materials of the present invention have excellent thermal stabilities in comparison with conventional thermosensitive recording materials consisting essentially of a single thermosensitive layer and a substrate. However, provided that the main cause of the decrease in the thermal stability of the conventional thermosensitive layer is the oxidation of acidic developers at a high temperature of about 80° C., it can be considered as a possible reason for the high thermal stability in the present invention that the first thermosensitive layer containing acidic developers is placed under the second thermosensitive layer containing leuco-dyes in the laminated structure of the present invention, and thus the acidic developer is not easily susceptible to the deterioration of thermal stability due to oxidation.

The fact that the leuco-dye and the acidic developer are physically separated and therefore cannot easily react with each other may be another reason but is not considered to be an essential reason. For example, in the case where the second thermosensitive layer (leuco-dye layer) and the first thermosensitive layer (acidic developer layer) were laminated on a substrate in this order, i.e., in the reverse order of the present invention, prevention of fogging is only slightly enhanced in comparison with the conventional mixed thermosensitive layer, but no substantial improvement is exhibited as obtained in the present invention. Especially, the prevention of fading of printed recording and decrease in color-producing performance of stored unprinted materials is not obtained at all in this case.

In the following description, quantities expressed in "part" and "% (percent)" are by weight unless otherwise specified.

Figure 1:
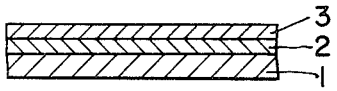
FIGS. 1 through 7 are cross-sections taken in planes lying in the direction of thickness of respective thermosensitive recording materials of the present invention.

In the most fundamental embodiment of this invention, the thermosensitive recording material of the present invention is characterized by a structure in which the first thermosensitive layer 2 containing an acidic developer and the second thermosensitive layer 3 containing a leuco-dye are formed in this coating sequence on a substrate 1 as illustrated in FIG. 1.

As the substrate, any suitable material such as paper, plastic film, or plastic sheet can be used. In consideration of its use for the long-term cards, the preferred substrates are films or sheets produced from plastic materials such as polyester, polyacetate, polystyrene and polycarbonate, as well as composite sheets and the like produced from these plastic films and other sheet-like materials such as paper.

The first thermosensitive layer comprises an acidic developer dispersed into a solid vehicle. As the acidic developer, phenolic compounds can preferably be used. By the phenolic compound is meant a compound having one or more phenolic groups. They include, for example, phenol, o-cresol, p-cresol, p-ethylphenol, t-butylphenol, 2,6-di-t-butyl-4-methylphenol, nonylphenol, dodecylphenol, styrene-modified phenol, 2,2'-methylene-bis(4-methyl-6-t-butylphenol), $\alpha$-naphthol, $\beta$-naphthol, hydroquinone monomethyl ether, guaiacol, eugenol, p-chlorophenol, p-bromophenol, o-bromophenol, o-chlorophenol, 2,4,6-trichlorophenol, o-phenylphenol, p-phenylphenol, p-(p-chlorophenyl)-phenol, o-(o-chlorophenyl)phenol, salicylic acid, ethyl p-hydroxybenzoate, propyl p-hydroxybenzoate, octyl p-hydroxybenzoate, dodecyl p-hydroxybenzoate, catechol, hydroquinone, resorcin, 3-methylcatechol, 3-isopropylcatechol, p-t-butylcatechol, 2,5-di-t-butylhydroquinone, 4,4'-methylenediphenol, Bisphenol A, 1,2-dihydroxynaphthalene, 2,3-dihydroxynaphthalene, chlorocatechol, bromocatechol, 2,4-dihydroxybenzophenone, phenolphthalene, o-cresolphthalene, methyl protocatechuate, ethyl protocatechuate, propyl protocatechuate, octyl protocatechuate, dodecyl protocatechuate, pyrogallol, oxyhydroquinone, phloroglucin, 2,4,6-trihydroxymethylbenzene, 2,3,4-trihydroxyethylbenzene, gallic acid, methyl gallate, ethyl gallate, propyl gallate, butyl gallate, hexyl gallate, octyl gallate, dodecyl gallate, cetyl gallate, stearyl gallate, 2,3,5-trihydroxynaphthalene, tannic acid, and phenolic resins.

The acidic developer is used in a quantity of 2 to 70% and preferably 30 to 70% of the quantity of the first thermosensitive layer.

The second thermosensitive layer comprises a leuco-dye dispersed in a solid vehicle. The leuco-dyes include, for example, triphenylmethane dyes such as Crystal Violet lactone and Malachite Green lactone; fluoran dyes such as 1,2-benzo-6-diethylaminofluoran; auramine dyes such as N-benzoylauramine; as well as phenothiazine dyes, and spiropyran dyes. The leuco-dye is used in a quantity of 2 to 70% and preferably 30 to 70% of the quantity of the second thermosensitive layer.

The color-producing system itself comprising combinations of leuco-dyes with acidic developers such as phenolic compounds has been known in the art, and thus combinations of the compounds other than those exemplified above can also be used in the present invention. Preferred solid vehicles for dispersion of the acidic developers and leuco-dyes as described above to form the first and second thermosensitive layers are organic solvent-soluble and especially naphthenic solvent-soluble homo- or co-polymers such as xylene resin, phenolic resin, coumarone resin, vinyl toluene resin, terpene resin, vinyltoluene-butadiene copolymer, and vinyltoluene-acrylate copolymer. Water-soluble resins such as polyvinyl alcohol, methyl cellulose, hydroxyethyl cellulose, carboxymethyl cellulose, methyl vinyl ether/-maleic anhydride copolymer, polyacrylic acid, gelatin, and arabic gum may also be used. However, the above-mentioned organic solvent-soluble resins are preferred because, when water is used as solvent, drying in the coating step for forming thermosensitive layers takes a longer time, whereby production efficiency is lowered, and the adhesion with plastic resin films which are excellent as the substrates for long-term cards becomes inferior. The solid vehicles used for the first and second thermosensitive layers are ordinarily the same but may be different from each other.

In forming the first or second thermosensitive layer from the above described components, the solid vehicle and the acidic developer or the leuco-dye are dissolved or dispersed in an organic solvent preferably consisting essentially of a naphthenic solvent which dissolves the solid vehicle but does not dissolve the developer or the leuco-dye or water, or the like to obtain an ink having a viscosity of about 1 to about 500 poises. The resulting ink is applied as a coating onto the entire surface or pattern-like portions of a substrate in a quantity of ordinarily 2 to 40 g/m$^2$ (solid basis) by means of a printing method such as gravure, flexo or silkscreen or a coating method using a roll coater, reverse coater, bar coater or knife coater, followed by drying.

The fundamental embodiment of the present invention is as described above, but various modifications can be made within the scope of the present invention. Examples of such modifications are as further described below, some of which are of substantial significance from the viewpoint of providing excellent thermosensitive recording materials for long-term cards.

For example, the adhesion property between the thermosensitive layers and the substrate layers is one of the key factors for producing excellent thermosensitive recordings. More specifically, when a thermosensitive layer is printed with a thermal head, the tendency of the solid vehicle in the thermosensitive layer to be softened by the heat and to stick to the thermal head is more or less unavoidable. Thus, if the adhesive strength between the substrate and the thermosensitive layer is insufficient, the color-produced printed portions of the thermosensitive layer adhere to the head and are taken off, which sometimes causes broken printing or adhesion of tailings to the head and defective tracing of the head.

Figure 2:
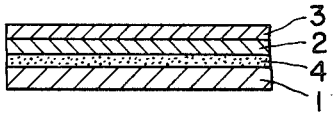

In this connection, the adhesion property between the thermosensitive layer and plastic films used as the substrate for long-term cards is not always sufficient even when an organic solvent-soluble resin is used as the solid vehicle in the thermosensitive layer. In such a case, the adhesion can be effectively improved by inserting a primer layer 4 between the substrate 1 and the first thermosensitive layer 2, as shown in FIG. 2. Basically, primer resins which are suitable for use are the materials having good adhesive properties relative to both the substrate 1 and the first thermosensitive layer.

The preferred primer resins include, for example, acrylic resin, saturated polyester resin, polyvinyl acetate resin, and mixtures of polyester resin and polyisocyanate resin. These resins are especially suitable when polyester film is used as the substrate. In this embodiment of the invention, it is especially preferable to add 30 to 200 parts of an acidic developer such as Bisphenol A per 100 parts of these primer resins. In the case where a primer layer 4 is applied, the adhesion between the primer layer 4 and the first thermosensitive layer 2 is retarded mainly by poor wetting due to the presence of an acidic developer in the thermosensitive layer. It has been found that, by the addition of the acidic developer to the primer layer 4, the wetting between the first thermosensitive layer and the primer layer is improved, and the adhesion between the substrate 1 and the first thermosensitive layer 2 is also improved.

Such a primer layer 4 is formed in a quantity of 0.5 to 4 g/m$^2$ (solid basis) on the substrate.

Figure 3:
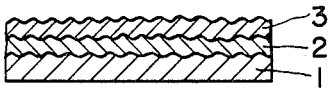

By roughening the surface of the substrate 1 as shown in FIG. 3 or using an additional roughening layer (mat layer, not shown), the adhesive property between the substrate 1 and the thermosensitive layer 2 (or the property with a primer layer 4 when there is applied the primer layer 4 as shown in FIG. 2) is improved, and the thermosensitive top layer 3 is also roughened. This is sometimes effective for decreasing surface tack.

As in conventional methods, the thermosensitive layer 2 and/or 3 of the present invention can contain therein, for the purpose of preventing these thermosensitive layers from acquiring scratched coloring, up to about 20% (based on total weight) of a surface-smoothening agent selected from waxes such as paraffin wax, polyethylene wax, carnauba wax, microcrystalline wax, and amide wax, or inorganic fillers such as precipitated barium sulfate, alumina, acid clay, silica gel, clay, and silicon oxide.

Figure 4:
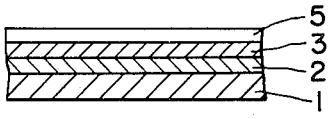

For the purpose of decreasing the surface tack of the thermosensitive layer, preventing adhesion of tailings on the thermal head, improving the tracing property of the thermal head, avoiding scratched coloring and so forth, it is also effective to apply an overcoat layer 5 onto the thermosensitive layer as shown in FIG. 4. It is to be noted that the effect of enhancing the thermal stability of the present thermosensitive layers 2 and 3 due to their special separated arrangement is clearly observed even when such an overcoat layer is applied. A preferred overcoating material is a mixture of a solid vehicle used as a binder (illustrated above for thermosensitive layers) and 10 to 70% of a wax or inorganic filler (illustrated above as additional components to be used in thermosensitive layers). It has been found that a silicone-modified wax alone or a mixture of the wax and a fluorocarbon used in a quantity of 10 to 70% of the binder is especially useful for the above mentioned purpose. Such an overcoat layer 5 is formed in a quantity of 0.5 to 3 g/m$^2$.

Figure 5:
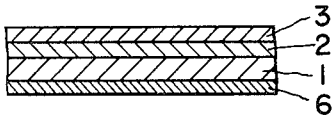

Furthermore, a magnetic recording layer 6 can also be applied as shown in FIG. 5 to the other surface of the substrate 1 opposite the surface on which the thermosensitive layers 2 and 3 are applied. By so doing, other difficulties such as the impossibility of rewriting of the recordings in thermosensitive recording materials, limitation of the amount of information which can be recorded, difficulty of mechanical reading and inadequate prevention of forgery can be overcome.

Figure 6:
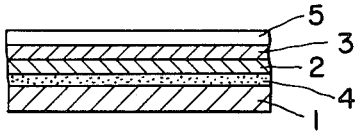
Figure 7:
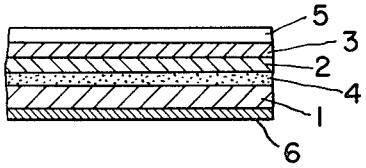

When the economical aspect is also considered, the optimum layer structures of the present recording materials to be used for long-term cards are exemplified by the materials wherein the primer layer 4, the first thermosensitive layer 2, the second thermosensitive layer 3, and the overcoat layer 5 are laminated on the substrate 1 in this order as illustrated in FIG. 6, as well as the materials wherein the magnetic recording layer 6 is further applied onto the other surface of the substrate 1 opposite to the thermosensitive layers 2 and 3 as illustrated in FIG. 7.

As described above, the acidic developer and leuco-dye ordinarily coexist in the conventional thermosensitive layer. In accordance with the present invention, the acidic developer and leuco-dye are separately dispersed in the first and second thermosensitive layers respectively, and these layers are formed on the substrate layer in this order. There is thus provided a thermosensitive recording material suitable for relatively long-term repeated uses such as those of season tickets or passes and credit cards, because the thermal stability of the recording material is markedly improved and especially the thermosensitive recording material can be readily combined with other additional layers. The thermosensitive recording material of the present invention can also be applied to short-period uses such as one-way tickets and facsimile paper by selecting the substrate and the like accordingly. These modifications would be easily understood by those skilled in the art.

The present invention will be further described by way of examples.

EXAMPLE 1

Ink A having the following composition was applied as a coating by a reverse roll coater on a commercial 0.188 mm-thick milk-white polyester film and then dried at 70° C. for 1 minute to form thereon a first thermosensitive layer having a coated weight of 4 g/m$^2$ (on a dry basis, as in all of the following examples). Ink B having the following composition was further applied as a coating on the first layer and dried at 70° C. for 1 minute to form a second thermosensitive layer having a coated weight of 3 g/m$^2$. Thus a thermosensitive recording material corresponding to FIG. 1 of the present invention was obtained.

| Ink A: | |
|---|---|
| Bisphenol A | 17 parts |
| vinyltoluene/butadiene copolymer resin | 17 parts |

-continued

| | |
|---|---|
| (Priolite VT from Goodyear Tire & Rubber Co.) | |
| ethylcyclohexane | 66 parts |
| Ink B: | |
| fluoran leuco-dye (TH 106 from Hodogaya Kagaku K.K., Japan) | 17 parts |
| vinyltoluene/butadiene copolymer resin (the same as used above) | 17 parts |
| ethycyclohexane | 66 parts |

The inks A and B were respectively prepared by mixing for 1 hour their respective above-listed components in a mixer containing glass beads.

The resulting recording material was printed on its thermosensitive layer by a thermal printer (KH-58 manufactured by Tōyō Dengu Seisakusho, Japan) under the conditions of a head voltage of 14 V, an application time of 3.17 seconds, and a head power of 0.6 W/3.9×10$^{-4}$ cm$^2$, and thus clear black images were obtained.

Recording materials obtained in the same manner were subjected to shelf tests at 80° C. for 20 hours before and after the printing, respectively. It was observed that there was almost no fogging, or fading of the printed recording, or decrease in color-producing performance of the unprinted material and that the thermal stability was markedly enhanced.

The results of comparison tests with conventional recording materials are summarized below.

COMPARISON EXAMPLE 1

The inks A and B described in Example 1 were mixed in a ratio by weight of 2:5 for 10 minutes by means of a propeller mixer to obtain a thermosensitive color ink. The resulting ink was applied as a coating on a polyester film as described above in Example 1 by a reverse roll coater and then dried at 60° C. for 1 minute to form thereon a single thermosensitive layer having a coated weight of 4 g/m$^2$.

COMPARISON EXAMPLE 2

Example 1 was repeated, except that the two inks were applied in the reverse order of ink B and ink A, to obtain a thermosensitive recording material.

The color-producing performance and thermal stability of the resulting thermosensitive recording materials were tested and found to be as shown in the following table together with those obtained in Example 1.

| Recording materials | | Optical Density Ex. 1 | Comp. Ex. 1 | Comp. Ex. 2 |
|---|---|---|---|---|
| Color-producing performance (optical density) | | 1.31 | 1.35 | 1.31 |
| Thermal stability | fogging | +0.04 | +0.06 | +0.04 |
| | fading of print | 1.27 | 0.50 | 0.75 |
| | color-producing performance after heated shelf test | 1.22 | 0.97 | 0.96 |

From the aphenolic compound and the leuco-dye separately (Example 1) in accordance with the present invention is approximately the same with respect to color-producing performance and is highly improved with respect to thermal stability in comparison with the conventional recording material (Comparative Example 1) prepared by coating with a mixture of those components. The control recording material obtained by coating with the leuco-dye and the phenolic compound in the reverse order (Comparative Example 2) is not greatly different with respect to fogging but greatly differs in fading of the printed recording and decrease in color-producing performance after the heated shelf test.

The methods and standards used for evaluation of the above test items were as follows.

COLOR-PRODUCING PERFORMANCE

The recording material to be tested, substantially immediately after production, was subjected to printing by a thermal head (KH-58 manufactured by Tōyō Dengu Seisakusho, Japan) under the conditions of an applied voltage of 16 V, a printing time of 3.14 m sec. and an applied power of 0.60 W/3.9×10$^{-4}$ cm$^2$. The optical density of the printed portions was determined by means of an RD-100 meter (using Kodak Wratten filter #106) supplied from McBeth Company.

THERMAL STABILITY

Fogging:

Printed recording materials were allowed to stand at 80° C. for 20 hours, and the optical density of unprinted portions thereof was measured. Degree of fogging was rated by the change in density before and after the shelf test.

Fading of printed recording:

Printed recording materials were allowed to stand at 80° C. for 20 hours, and the optical density of printed portions thereof was measured.

Color-producing performance:

Unprinted recording materials were allowed to stand at 80° C. for 20 hours, and then the performance was determined as described above.

EXAMPLE 2

A matting agent having the following composition was applied as a coating on a commercial 0.188μ-thick milk-white polyester film to form a 15μ-thick mat layer (of a depth of mat of 4 to 5μ).

| | |
|---|---|
| acryl polyol (Thermolac U-230 manufactured by Soken Kagaku K.K., Japan) | 50 parts by wt. |
| isocyanate (Takenate D-110N) | 30 parts by wt. |
| silicon oxide (average particle size 4μ) | 20 parts by wt. |
| toluene | 12 parts by wt. |
| ethyl acetate | 12 parts by wt. |
| methyl ethyl ketone | 50 parts by wt. |

The same inks as those in Example 1 were used for thermosensitive ink layers. The phenolic compound layer (ink A) and leuco-dye layer (ink B) were separately applied as coating on the mat layer in this order by means of a reverse roll coater in the same manner as in Example 1 to obtain a thermosensitive color-forming layer thereon. The resulting thermosensitive recording portions exhibited excellent color-producing performance and thermal stability to the same degree as in Example 1.

EXAMPLE 3

Thermosensitive inks A and B having the following compositions were prepared. The ink A and ink B were applied as coatings and dried in this order on a commercial Kent paper (200 g/m$^2$) in the same manner as in Example 1 to form a thermosensitive recording layer thereon.

| | |
|---|---|
| Ink A: | |
| Bisphenol A | 17 parts by wt. |
| cyclized rubber | 17 parts by wt. |
| ethylcyclohexane | 66 parts by wt. |
| Ink B: | |
| fluoran leuco-dye (PSD-170 manufactured by Shinnisso Kako K.K., Japan) | 17 parts by wt. |
| cyclized rubber (Thermolite N manufactured by Seiko Kagaku K.K., Japan) | 17 parts by wt. |
| ethycyclohexane | 66 parts by wt. |

The resulting thermosensitive recording material exhibited excellent color-producing performance and thermal stability to the same degree as in Example 1.

EXAMPLE 4

A primer ink A having the following composition was applied as a coating on a commercial 0.188 mm-thick milk-white polyester film by means of a reverse roll coater and then dried at 100° C. for 1 minute to form a primer layer having a coated weight of 2 g/m$^2$. The following ink B was further applied as a coating thereon and dried at 70° C. for 1 minute to form a first thermosensitive layer having a coated weight of 4 g/m$^2$. Next the following ink C was applied as a coating thereon and dried at 70° C. for 1 minute to form a second thermosensitive layer having a coated weight of 3 g/m$^2$. The following ink D was further applied as a coating thereon and dried at 70° C. for 1 minute to form an overcoating layer having a coated weight of 1 g/m$^2$. Thus, a thermosensitive recording material corresponding to FIG. 6 was obtained.

| | |
|---|---|
| Ink A: | |
| polyester resin (Viron 200 manufactured by Toyobo K.K., Japan) | 3 parts by wt. |
| polyvinyl acetate resin (Vinylite VAGH manufactured by Union Carbide Corp.) | 2.5 parts by wt. |
| isocyanate (Takenate D-110N manufactured by Takeda Yakuhin Kogyo K.K.) | 2 parts by wt. |
| Bisphenol A | 3.5 parts by wt. |
| toluene | 30 parts by wt. |
| methyl ethyl ketone | 10 parts by wt. |
| Ink B: | |
| Bisphenol A | 17 parts by wt. |
| vinyltoluene/butadiene copolymer resin (Priolite VT manufactured by Goodyear Tire & Rubber Co.) | 17 parts by wt. |
| ethylcyclohexane | 66 parts by wt. |
| Ink C: | |
| fluoran leuco-dye (TH106 manufactured by Hodogaya Kagaku K.K., Japan) | 17 parts by wt. |
| vinyltoluene/butadiene copolymer resin (the same as above) | 17 parts by wt. |
| ethylcyclohexane | 66 parts by wt. |

-continued

| | |
|---|---|
| Ink D: | |
| vinyltoluene/butadiene copolymer resin (the same as above) | 3 parts by wt. |
| silicone modified wax (10% ethylcyclohexane solution) (KF3935 manufactured by Shinetsu Kagaku K.K., Japan) | 10 parts by wt. |
| fluorocarbon (50% toluene solution) (MoLD WIZ F-57 manufactured by Toyo Soda Kogyo K.K., Japan) | 2 parts by wt. |
| ethylcyclohexane | 27 parts by wt. |

The resulting thermosensitive recording material was subjected to printing on its thermosensitive layer by means of a thermal printer (KH-58 mfd. by Tōyō Dengu Seisakusho, Japan) under the conditions of a head voltage of 14 V, an application time of 3.17 m sec., and a head electric power of 0.6 W/3.9$\times 10^{-4}$ cm$^2$. Thus, clear black images were obtained.

Recording materials obtained in the same manner were subjected to shelf tests at 80° C. for 20 hours before and after the printing, respectively. It was observed that there was almost no fogging, fading of the print, or decrease in color-producing performance of unprinted material, and that the thermal stability was markedly improved.

What is claimed is:

1. A laminated thermosensitive recording material comprising a substrate, a primer layer adjacent to said substrate comprising a primer resin and an acidic developer, a first thermosensitive layer adjacent to said primer layer comprising a solid vehicle with an acidic developer dispersed therein, and a second thermosensitive layer adjacent to said first thermosensitive layer comprising a solid vehicle with a leuco-dye dispersed therein.

2. A thermosensitive recording material in accordance with claim 1, wherein said acidic developer is a phenolic compound.

3. A thermosensitive recording material in accordance with claim 1 or 2, wherein the surface of said substrate which is adjacent to said primer layer is roughened.

4. A thermosensitive recording material in accordance with claim 3, wherein an overcoat resin layer is applied adjacent to the surface of said second thermosensitive layer which is opposite the surface of said second thermosensitive layer adjacent to said first thermosensitive layer.

5. A thermosensitive recording material in accordance with claim 4, wherein said overcoat resin layer contains a surface smoothening agent selected from the group consisting of waxes and inorganic fillers.

6. A thermosensitive layer in accordance with claim 4, wherein said first thermosensitive layer contains a surface smoothening agent selected from the group consisting of waxes and inorganic fillers.

7. A thermosensitive layer in accordance with claim 3, wherein said first thermosensitive layer contains a surface smoothening agent selected from the group consisting of waxes and inorganic fillers.

8. A thermosensitive recording material in accordance with claim 1 or 2, wherein an overcoat resin layer is applied adjacent to the surface of said second thermosensitive layer which is opposite the surface of said second thermosensitive layer adjacent to said first thermosensitive layer.

9. A thermosensitive recording material in accordance with claim 8, wherein said overcoat resin layer contains a surface smoothening agent selected from the group consisting of waxes and inorganic fillers.

10. A thermosensitive layer in accordance with claim 9, wherein said first thermosensitive layer contains a surface smoothening agent selected from the group consisting of waxes and inorganic fillers.

11. A thermosensitive layer in accordance with claim 8, wherein said first thermosensitive layer contains a surface smoothening agent selected from the group consisting of waxes and inorganic fillers.

12. A thermosensitive layer in accordance with claim 1 or 2, wherein said first thermosensitive layer contains a surface smoothening agent selected from the group consisting of waxes and inorganic fillers.

13. A thermosensitive recording material in accordance with claim 1 or 2, wherein said second thermosensitive layer further contains a surface smoothening agent selected from the group consisting of waxes and inorganic fillers.

14. A thermosensitive recording material in accordance with claim 1 or 2, wherein a magnetic recording layer is formed on the surface of said substrate opposite to the surface of said substrate which is adjacent to said primer layer.

* * * * *